United States Patent [19]

Kodama et al.

[11] Patent Number: 5,069,639

[45] Date of Patent: Dec. 3, 1991

[54] METAL TERMINAL RETAINING MECHANISM FOR CONNECTOR

[75] Inventors: Shinji Kodama; Satoshi Yamada; Sakai Yagi, all of Shizuoka, Japan

[73] Assignee: Yazaki Corporation, Tokyo, Japan

[21] Appl. No.: 664,232

[22] Filed: Mar. 4, 1991

[30] Foreign Application Priority Data

Mar. 8, 1990 [JP] Japan ..... 2-55009

[51] Int. Cl.[5] ..... H01R 13/44

[52] U.S. Cl. ..... 439/595; 439/594; 439/752

[58] Field of Search ..... 439/592, 594, 595, 598, 439/752

[56] References Cited

U.S. PATENT DOCUMENTS

| | | | |
|---|---|---|---|
| 4,902,247 | 2/1990 | Suzuki et al. | 439/595 |
| 4,921,448 | 5/1990 | Endo et al. | 439/595 |
| 4,946,398 | 8/1990 | Takensuchi et al. | 439/595 |
| 4,973,268 | 11/1990 | Smith et al. | 439/594 |
| 4,975,082 | 12/1990 | Nagasaka et al. | 439/594 |

*Primary Examiner*—Paula A. Bradley

*Attorney, Agent, or Firm*—Sughrue, Mion, Zinn, Macpeak & Seas

[57] ABSTRACT

An electrical connector retains metal terminals more positively without insertion and removal problems caused by fatigue of any part of the connector mechanism. A spacer is provided with a drive control portion having a retaining release projection and a retaining fixture projection, both of which engage driven projections within the connector housing to enable provisional and complete connection of a metal terminal in the housing.

4 Claims, 4 Drawing Sheets

METAL TERMINAL RETAINING MECHANISM FOR CONNECTOR

BACKGROUND OF THE INVENTION

This invention relates to an improved metal terminal retaining mechanism for an electrical connector for connecting wire harnesses or the like.

In FIG. 6, a connector housing a has a plurality of juxtaposed upper terminal receiving chambers c, a plurality of juxtaposed lower terminal receiving chambers c, and a receiving chamber b provided between the upper and lower terminal receiving chambers. A spacer g is inserted in the receiving chamber b.

As shown in FIG. 7, first and second flexible retaining pieces e and f for retaining a metal terminal d are provided in each terminal receiving chamber c. A retaining end e1 of the first flexible retaining piece e is disposed in a path of insertion of the metal terminal d into the terminal receiving chamber c. When the metal terminal d is inserted into the terminal receiving chamber, the retaining end e1 is displaced outwardly by the metal terminal d and then is restored to its initial position to engage with a first engaging portion d1 of the metal terminal d. A retaining end f1 of the second flexible retaining piece f is disposed out of the path of insertion of the metal terminal d into the terminal receiving chamber. After the metal terminal d is inserted, the spacer g is inserted into the terminal receiving chamber b to displace the retaining end f1 forcibly so as to engage the retaining end f1 with a second engaging portion d2 of the metal terminal d, thereby retaining the metal terminal d in a double retaining manner.

In the above conventional device, when the connector housing a is placed in a high-temperature atmosphere for a long time, the second flexible retaining piece f remains deformed in the forcibly-displaced posture. Even when the spacer g is removed, the second flexible retaining piece does not return to its initial shape, resulting in an inability to remove the metal terminal b.

SUMMARY OF THE INVENTION

In view of the foregoing, it is an object of this invention to provide a construction in which, in a connector housing having first and second flexible retaining pieces, a metal terminal can be removed easily even when the flexible retaining piece is deformed because of high temperature or the like.

This object has been achieved by a metal terminal retaining mechanism for a connector, constituted by a connector housing having two flexible retaining pieces provided in a terminal receiving chamber so as to retain a metal terminal, and a spacer movably connectable to the connector housing. In a provisional retaining position of the spacer, one of the flexible retaining pieces is driven to a position out of engagement with the metal terminal. In a complete retaining position of the spacer, that flexible retaining piece is driven to a position where it is engaged with the metal terminal.

DETAILED DESCRIPTION OF THE PREFERRED EMBODIMENT

Figure 1:
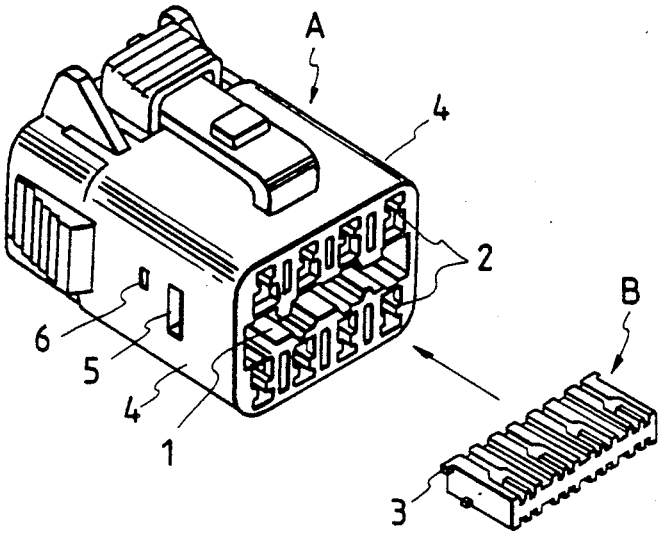
FIG. 1 is an exploded, perspective view of a preferred embodiment of the present invention.

Referring to FIG. 1, a connector housing A is integrally molded of a synthetic resin. A spacer B is made similarly of a synthetic resin.

The connector housing A has a plurality of juxtaposed upper terminal receiving chambers 2, a plurality of juxtaposed lower terminal receiving chambers 2, and a receiving chamber 1 provided between the upper and lower terminal receiving chambers. The spacer B is inserted into the receiving chamber 1. Retaining pieces 3 are formed on and projected from respective opposite sides of the spacer B. A provisional retaining hole 5 and a complete retaining hole 6 are formed through each of opposite side walls 5 of the connector housing A.

Therefore, the spacer B is connected to the connector housing A in a two-stage manner, that is, first in a provisional retaining condition in which the retaining pieces 3 are engaged respectively in the provisional retaining holes 5, and then in a complete retaining condition in which the retaining pieces 3 are engaged respectively in the complete retaining holes 6.

Figure 3A:
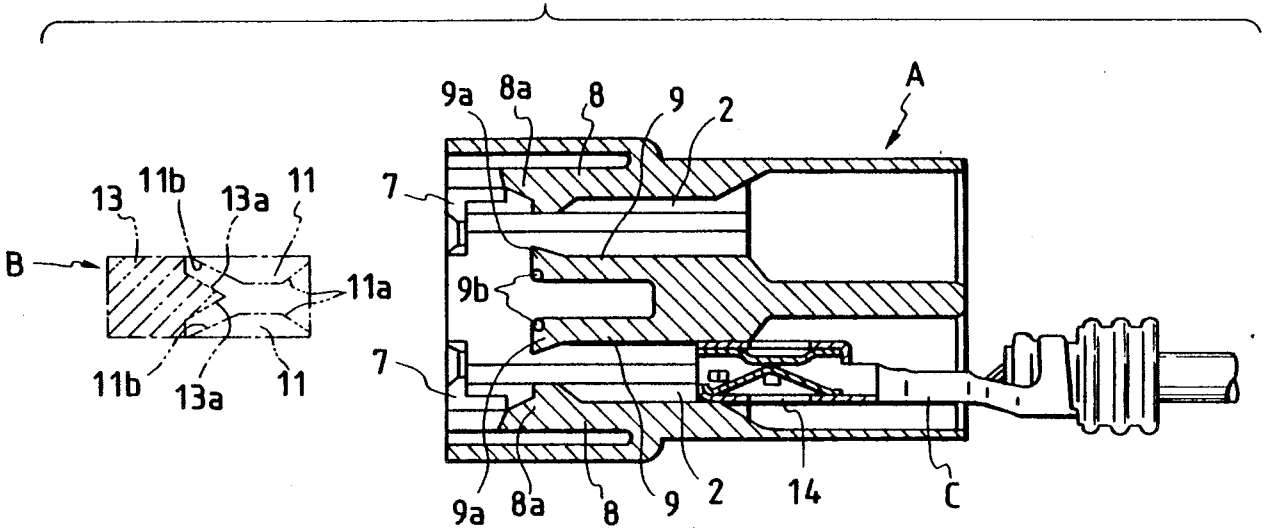
FIG. 3A is a cross-sectional view showing a condition in which the spacer is disengaged from a connector housing.
Figure 3B:
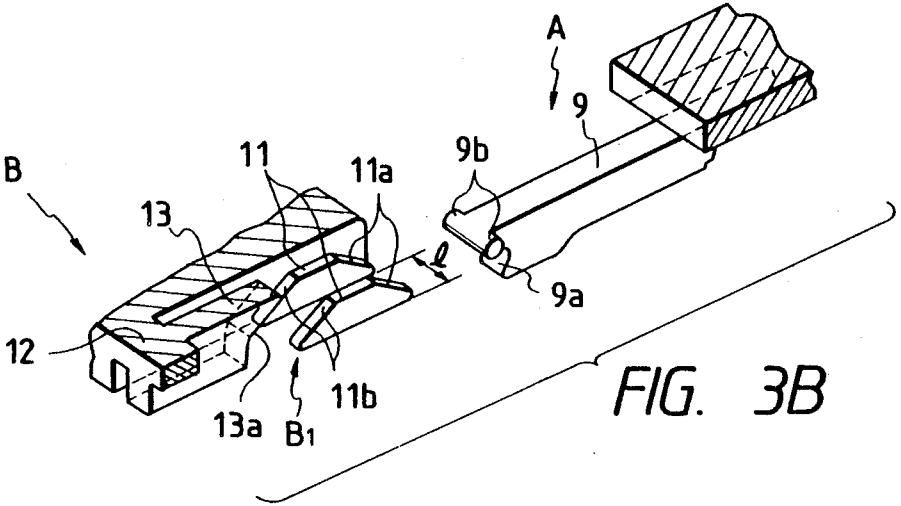
FIG. 3B is a perspective view showing the above condition.
Figure 5A:
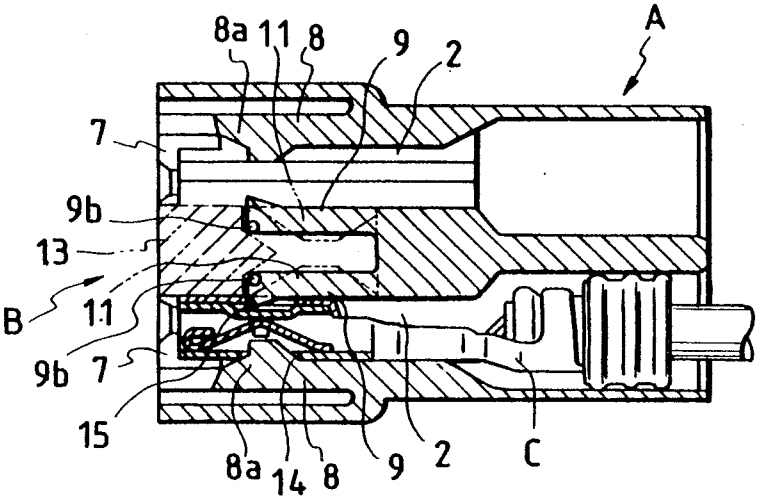
FIG. 5A is a cross-sectional view showing a condition in which the spacer is completely connected to the connector housing.
Figure 5B:
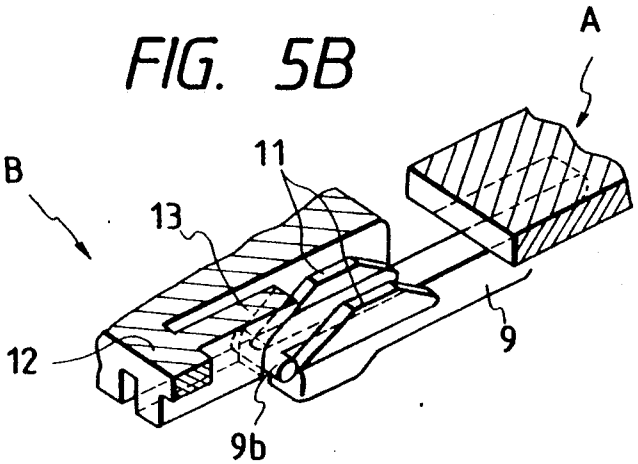
FIG. 5B is a perspective view showing the above completely-connected condition.

As shown in FIG. 3A, a stopper 7 is provided at the front end of each terminal receiving chamber 2 of the connector housing A. First and second flexible retaining pieces 8 and 9 are provided in the terminal receiving chamber. Retaining portions 8*a* and 9*a* are formed respectively on the ends of the first and second flexible retaining pieces 8 and 9, and are disposed in a path of insertion of a metal terminal C. Further, driven projections 9*b*, formed on the end of the second flexible retaining piece 9, project respectively from the opposite sides thereof in a direction perpendicular to the axis of the second flexible retaining piece 9.

Figure 2:
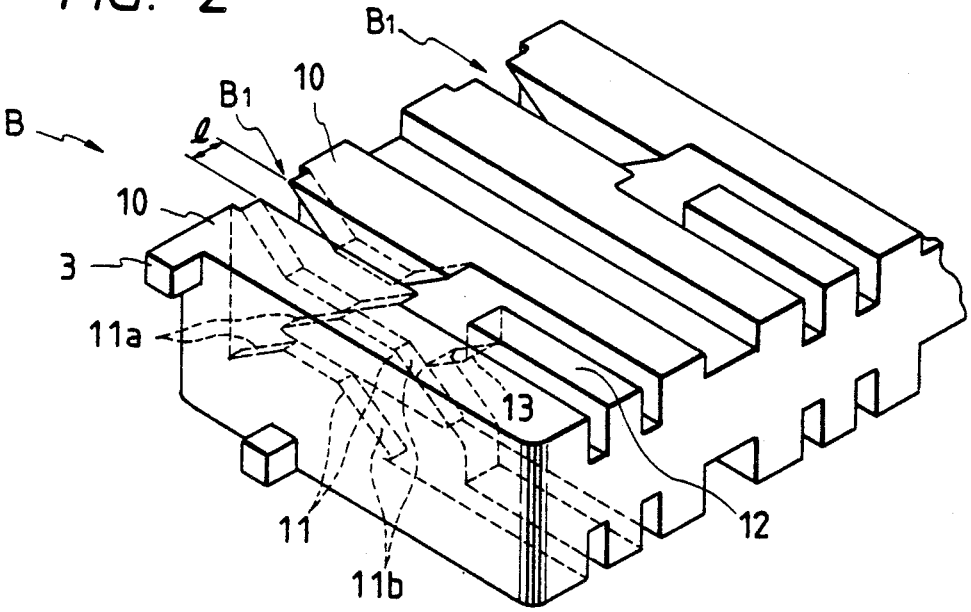
FIG. 2 is a perspective view of a spacer.

The spacer B has drive control portions B1 for acting respectively on the second flexible retaining pieces 9 provided in the respective terminal receiving chambers 2. The drive control portion B1 has a pair of walls 10, 10 (FIG. 2) formed forwardly in the direction of insertion into the terminal receiving chamber 2. The pair of walls 10, 10 are spaced from each other a distance l so as to receive the second flexible retaining piece 9 therebetween. A retaining release projection 11, acting on a respective one of the driven projections 9*b* of the second flexible retaining piece 9, is formed on each of the walls 10. A retaining fixture projection 13, acting on the driven projections 9*b*, is formed on an intermediate wall 12 disposed rearwardly of the retaining release projections 11. The retaining release projection 11 has tapered guide surfaces 11*a* and 11*b* provided respectively at its front and rear portions. The retaining fixture projection 13 has tapered drive surfaces 13*a* each opposed to the tapered surface 11*b* with a spacing for receiving the driven projection 9*b*.

Figure 4A:
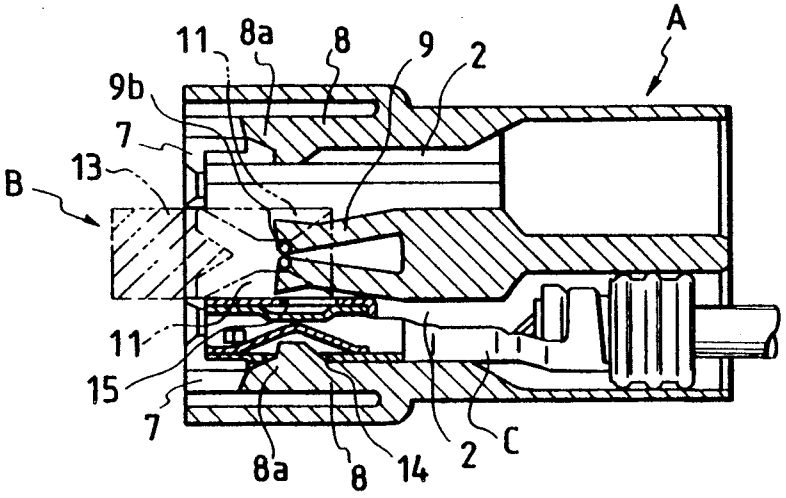
FIG. 4A is a cross-sectional view showing a condition in which the spacer is connected provisionally to the connector housing.
Figure 4B:
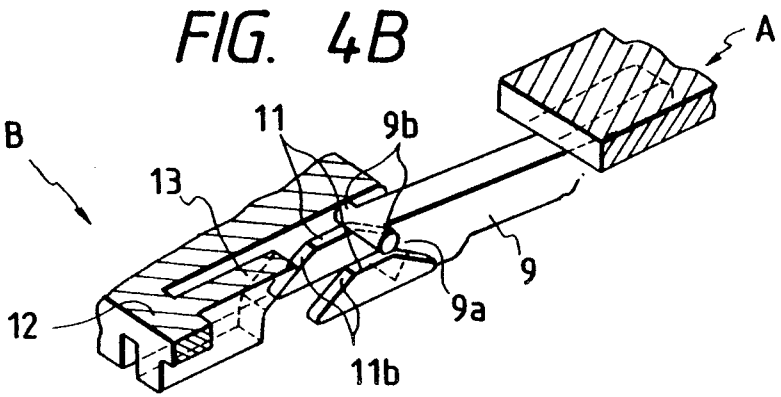
FIG. 4B is a perspective view showing the above provisionally-connected condition.
Figure 6:
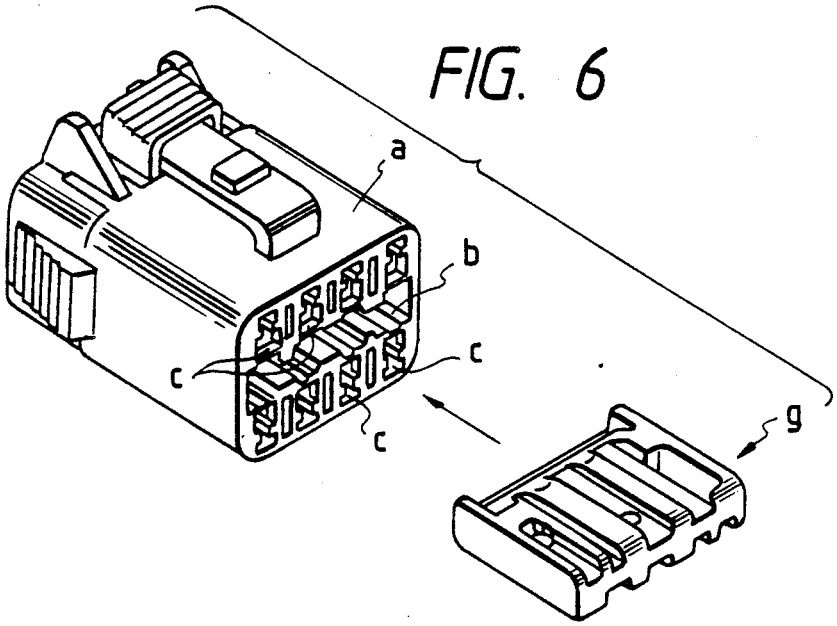
FIG. 6 is an exploded, perspective view of a conventional structure.
Figure 7:
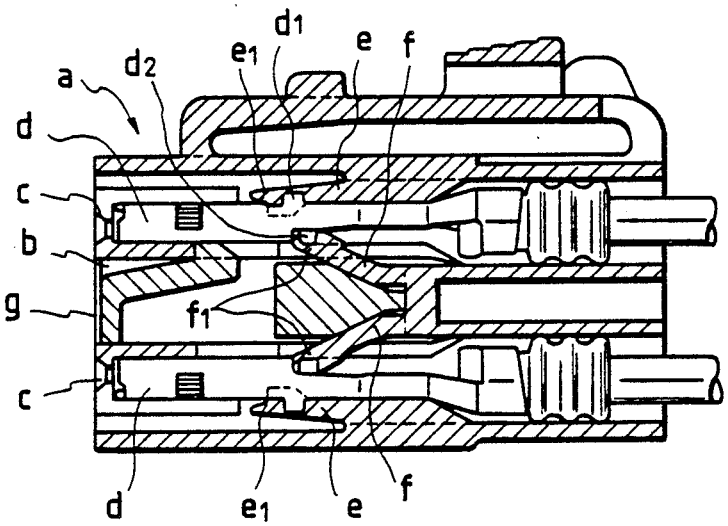
FIG. 7 is a cross-sectional view of the conventional structure.

In the above construction, as shown in FIG. 4A, when the spacer B is in provisionally connected relation to the connector housing A, the retaining release projections 11 displace the second flexible retaining piece 9 through the driven projections 9*b* to bring the retaining portion 9*a* out of the path of insertion of the metal terminal C. In this condition, by inserting the metal terminal C, the first flexible retaining piece 8 is displaced, and then is restored to its initial position, so that the retaining portion 8*a* is engaged in a retaining hole 14.

Then, when the spacer B is shifted to the complete connecting condition, the tapered drive surface 13*a* of the retaining fixture projection 13 restores the second flexible retaining piece 9 to its initial position through the driven projections 9*b*, so that the retaining portion 9*a* is engaged with a retaining step 15, thereby effecting a double retention.

When the metal terminal C is to be removed, the spacer B is returned to the provisional connecting position, thereby forcibly disengaging the second flexible retaining piece 9 from the metal terminal C, even if it is deformed by heat, and the first flexible retaining piece 8 is driven by a jig to be disengaged from the metal terminal. In this condition, the metal terminal is withdrawn.

As described above, the mechanism of the present invention is constituted by a connector housing having two flexible retaining pieces provided in the terminal receiving chamber so as to retain the metal terminal, and a spacer movably connectable to the connector housing. In the provisional retaining position of the spacer, one of the flexible retaining pieces is driven to the position where it is not engaged with the metal terminal. In the complete retaining position of the spacer, the flexible retaining piece is driven to a position where it is engaged with the metal terminal. With this construction, the flexible retaining piece is held in a position where it is disengaged from the metal terminal, and then the other flexible retaining piece is disengaged from the metal terminal. In this condition the metal terminal can be withdrawn easily.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. In an electrical connector, a metal terminal retaining mechanism comprising:

a connector housing having two flexible retaining pieces provided in a terminal receiving chamber so as to retain a metal terminal; and a spacer, movably connectable to said connector housing and having a provisional retaining position and a complete retaining position;

said spacer being configured such that, in a provisional retaining position of said spacer, one of said flexible retaining pieces is driven to a position out of engagement with said metal terminal; and said spacer further being configured such that, in a complete retaining position of said spacer, said one of said flexible retaining pieces is driven to a position in engagement with said metal terminal.

2. A mechanism according to claim 1, wherein said spacer includes at least one retaining piece, and said connector housing includes at least one provisional retaining hole and one complete retaining hole, said retaining piece being fitted into said provisional retaining hole in said provisional retaining position, and being fitted into said complete retaining hole in said complete retaining position.

3. A mechanism according to claim 1, wherein said spacer includes a drive control portion on which a retaining release projection and a retaining fixture projection, both acting on said one of said flexible retaining pieces, are provided, said retaining release projection acting on said one of said flexible retaining pieces to drive it out of engagement with said metal terminal, and said retaining fixture projection acting on said one of said flexible retaining pieces to drive it into engagement with said metal terminal.

4. A mechanism according to claim 3, wherein said one of said flexible pieces includes driven projections which engage said retaining release projection and said retaining fixture projection to drive said one of said flexible pieces into and out of engagement, respectively, with said metal terminal.

* * * * *